United States Patent [19]

Yamada et al.

[11] Patent Number: 4,960,664

[45] Date of Patent: Oct. 2, 1990

[54] DEVELOPER COMPOSITION FOR DEVELOPING ELECTROSTATIC IMAGE AND TONER IMAGE FORMING PROCESS

[75] Inventors: Hiroyuki Yamada, Fujisawa; Hiroyuki Takagiwa; Hiroya Masaki, both of Hachioji; Takahira Kasuya, Hino; Jiro Takahashi, Sagamihara; Masafumi Uchida, Hachioji; Satoru Ikeuchi, Hino, all of Japan

[73] Assignee: Konishiroku Photo Industry Co., Ltd., Tokyo, Japan

[21] Appl. No.: 412,551

[22] Filed: Sep. 25, 1989

Related U.S. Application Data

[63] Continuation of Ser. No. 79,636, Jul. 30, 1987, abandoned.

[30] Foreign Application Priority Data

Jul. 31, 1986 [JP] Japan ..... 61-178962
Jul. 31, 1986 [JP] Japan ..... 61-178964

[51] Int. Cl.[5] ..... G03G 9/10

[52] U.S. Cl. ..... 430/109; 526/934; 525/934; 524/901

[58] Field of Search ..... 430/109

[56] References Cited

U.S. PATENT DOCUMENTS 4,657,837 4/1987 Morita et al. ..... 430/109

FOREIGN PATENT DOCUMENTS 60339 4/1982 Japan ..... 430/99
244956 12/1985 Japan ..... 430/109
1240251 10/1986 Japan ..... 430/109

*Primary Examiner*—J. David Welsh
*Attorney, Agent, or Firm*—Finnegan, Henderson, Farabow, Garrett, and Dunner

[57] ABSTRACT

A toner for developing an electrostatic latent image containing a polyester resin binder obtained by condensation polymerization of a diol component and a mixture of acid components. The acid components are an aliphatic unsaturated dicarboxylic acid or an acid anhydride thereof and a polybasic carboxylic acid having not less than three carboxylic acid groups or an acid anhydride thereof. A ratio of the polybasic carboxylic acid having not less than three carboxylic acid groups or the acid anhydride thereof to the total acid components is in the range of from 5 mol % to less than 30 mol %.

10 Claims, No Drawings

DEVELOPER COMPOSITION FOR DEVELOPING ELECTROSTATIC IMAGE AND TONER IMAGE FORMING PROCESS

This application is a continuation of application Ser. No. 079,636, filed July 30, 1987, now abandoned.

FIELD OF THE INVENTION

The present invention relates to a developer composition for developing an electrostatic image formed in electrophotography, electrostatic printing, electrostatic recording and so forth, and also to a process for forming a toner image by using the same. Particularly, it relates to a developer composition for developing an electrostatic image, suited for color development used in a heated roller fixing system, and also to a process for forming a toner image by using the same.

BACKGROUND OF THE INVENTION

In electrophotography, it is usually practiced to forming an electrostatic latent image by charge and exposure to light, on a latent image carrier comprising a photoconductive photosensitive member, subsequently developing this latent image by use of a toner, and transferring the resulting toner image to a support such as transfer paper, followed by fixing the toner under heating or pressure.

Formation of a visible image formed through such an electrostatic latent image should preferably be achieved at high speed, and hitherto widely employed from this viewpoint has been a heated roller fixing system that can attain high thermal efficiency in the fixing process and can be more advantageous as compared with other systems.

Recently, however, it is strongly desired to achieve further higher speed processing, and a necessary condition for that purpose is to carry out the fixing of a toner at high speed.

Accordingly, it is necessary for a toner to have the properties or performances as shown below.

(1) To have a good triboelectric property.

More specifically, in order to develop an electrostatic latent image in a good state, it is necessary for a toner to show an appropriate polarity by triboelectric charge and yet to retain electrical charges in a charge quantity of an appropriate range.

(2) To have a good thermal fixing performance.

That is as follows: The heated roller fixing system can be preferably used as a means for fixing a toner. Since however in this heated roller fixing system the fixing is usually carried out by bringing a heated roller into contact with a toner, there is a tendency to cause the so called offset phenomenon that part of the toner which forms an image at the time of the fixing may be transferred to the surface of the heated roller when the temperature of the heated roller became higher, and this part may be again transferred to the image support such as transfer paper subsequently fed, to stain the image. Accordingly, in order to carry out the fixing in a good state, the minimum temperature at which the offset phenomenon may occur (hereinafter "offset occurring temperature") is required to be higher. Also, when the fixing of a toner is carried out at high speed according to the heated roller fixing system, the contact time of the toner with the heated roller is short, and the heat tends to be absorbed to the image support such as transfer paper to lower the temperature of the heated roller, whereby poor toner fixing may readily occur. Therefore, in order to prevent such poor fixing, the toner is required to be the one that can be sufficiently fixed even at lower temperature.

And, in the so-called black toner, it is relatively easy to control the triboelectric property of the toner since the carbon black usually used as a coloring agent has the charge controlling action and any charge controlling agent having a specific color can be used almost without any limitation.

However, in a color toner in which sharp coloration is required, it is generally not preferable to use a charge controlling agent having a specific color that may impair the color tone of a toner, and it is in practice considerably difficult to control the triboelectric property of the toner by use a pigment or dye usually used as a chromatic coloring agent. Accordingly, there are may limitations in selecting the charge controlling agent, and it is not necessarily easy to control the triboelectric property of the toner.

Also, in the case of the color toner, it is generally difficult for the chromatic coloring agent to be formed into fine particles of small particle size by grinding as compared with the carbon black in the black toner. Moreover, since the chromatic coloring agent has small compatibility with a binder, it tends to have insufficient dispersibility to its binder. As a result, it is difficult to obtain sufficient color density and opecifying ability.

To cope with this, it can be contemplated that the proportion of the content of the chromatic coloring agent in a toner may be made large to increase the color density and opecifying ability. By doing so, however, it follows that coloring particles having large particle size are present in toner particles in a high density. As a result, problems may arise such that not only the toner particles are readily broken, but also the softening point of the toner is increased to raise the minimum fixing temperature, and also the elasticity of a toner at the time of fusing is lowered to readily cause the offset phenomenon.

Thus, the state of things in the color toner is that there may be accompanied with many limitations in selecting resins used as the binder.

Also, recently has been disclosed a technique in which the resins as shown below are used as a binder of a toner.

(1) A cross linked polyester resin comprising linear polyesters obtained from a diol component containing a particular etherified bisphenol and a monomer component containing an aromatic dicarboxylic acid, cross-linked by a polybasic carboxylic acid having three or more carboxylic acid groups (proportion in the acid component: 30 to 80 mol %). (See Japanese Patent Publication Open to Public Inspection (hereinafter referred to as Japanese Patent O. P. I. Publication) No. 37353/1982).

(2) A cross-linked polyester resin comprising linear polyesters obtained from a monomer component containing a particular etherified bisphenol (proportion of propoxy groups: 50 mol % or more) and phthalic acids, cross-linked with an aromatic carboxylic acid having 3 or more carboxylic acid groups (proportion of content in the acid component: 40 mol % or less). (See Japanese Patent O.P.I. publication No. 29255/1984.)

In the resin of the above (1), however, since the proportion of the polybasic carboxylic acid having three or more carboxylic acid groups is 30 mol % or more, there may remain many unreacted carboxylic groups, whereby the resin may be readily affected by water content, and, as a result, in the toner the quantity of triboelectric charge may greatly change depending on humidity, to produce a problem that the image density may have a large environment dependency.

Also, in any of the resins of the above (1) and (2), since the aromatic carboxylic acid is used as a carboxylic acid having two carboxylic acid groups, the glass transition point of the resin is so high that, although no problem may be caused when the pressure by the heated roller is large and the contact time with the heated roller is long in the heated roller fixing system, there may be involved in a problem that the fixing performance is extremely worsened when the pressure by the heated roller is small and the contact time wIth the heated roller is short as in the case where the fixing is carried out at high speed.

SUMMARY OF THE INVENTION

The present invention was made in view of the circumstances as discussed above, and an object thereof is to provide a developer for development of an electrostatic image, having been improved in the following points (1) to (3), and a process for forming a toner image by use of the same.

(1) Can attain a sufficient triboelectric property, and, moreover, has a small change in the electrical charge quantity against humidity, and small environment dependency of the image density.

(2) Has an excellent fixing performance at low temperature, and enables high speed fixing.

(3) Can have a sufficient anti-offset property.

According to the present invention, there is provided a toner for developing an electrostatic latent image, which comprises, as a binder, a polyester resin obtained by polymerizing by condensation polymerization (a) a diol component comprising a mixture of diols expressed in terms of General Formula (1):

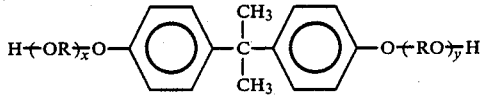

wherein, R is an ethylene group or a propylene group, and x and y respectively represent integers provided that the average of the total sum of x and y falls within a range of 2 to 7, and (b) a mixture of acid components comprising an aliphatic unsaturated dicarboxylic acid, an acid anhydride thereof or a derivative thereof and a polybasic carboxylic acid having not less than three carboxylic acid groups or an acid anhydride thereof, the proportion of the content of said polybasic carboxylic acid having not less than three carboxylic acid groups or the acid anhydride thereof to the total acid components being not less than 5 mol % and less than 30mol %.

There is also provided a color toner developing an electrostatic latent image, which comprises; a polyester resin obtained by polymerizing by condensation polymerization (a) a diol component comprising a mixture of diols expressed in terms of General Formula (1):

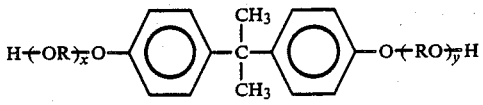

wherein, R is an ethylene group or a propylene group, and x and y respectively represent integers provided that the average of the total sum of x and y falls within a range of 2 to 7, and (b) a mixture of acid components comprising an aliphatic unsaturated dicarboxylic acid, an acid anhydride thereof or a derivative thereof and a polybasic carboxylic acid having not less than three carboxylic acid groups or an acid anhydride thereof, the proportion of the content of said polybasic carboxylic acid having not less than three carboxylic acid groups or the acid anhydride thereof to the total acid components being not less than 5 mol % and less than 30 mol %; and a chromatic coloring agent.

There is further provided a developer composition for developing an electrostatic latent Image, comprising: a toner which comprises, as a binder, a polyester resin obtained by polymerizing by condensation polymerization (a) a diol component comprising a mixture of diols represented by General Formula (1):

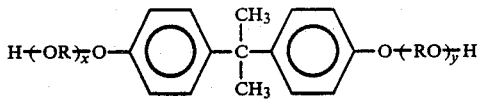

wherein, R is an ethylene group or a propylene group, and x and y respectively represent integers provided that the average of the total sum of x and y falls within a range of 2 to 7, and (b) a mixture of acid components comprising an aliphatic unsaturated dicarboxylic acid, an acid anhydride thereof or a derivative thereof and a polybasic carboxylic acid having not less than three carboxylic acid groups or an acid anhydride thereof the proportion of the content of said polybasic carboxylic acid having not less than three carboxylic acid groups or the acid anhydride thereof to the total acid components being not less than 5 mol % and less than 30 mol %; a chromatic coloring agent; and a resin coated carrier comprising a core material and a resin layer having coated thereon, said resin layer containing a fluorine-containing resin.

There is still further provided a method of fixing a toner image formed on a recording sheet, comprising a step of bringing said toner image formed on the recording sheet into contact with a heated roller under pressure, said toner comprising, as a binder, a polyester resin obtained by polymerizing by condensation polymerization (a) a diol component comprising a mixture of diols represented by General Formula (1):

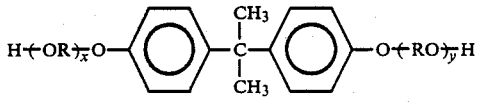

wherein, R is an ethylene group or a propylene group, and x and y respectively represent integers provided that the average of the total sum of x and y falls within a range of 2 to 7, and (b) a mixture of acid components comprising an aliphatic unsaturated dicarboxylic acid, an acid anhydride thereof or a derivative thereof and a polybasic carboxylic acid having not less than three carboxylic acid groups or an acid anhydride thereof, the proportion of the content of said polybasic carboxylic acid having not less than three carboxylic acid groups or the acId anhydride thereof to the total acid components being not less than 5 mol % and less than 30 mol %.

There is still further provided a method of forming a color image with a color toner in electrophotography, comprising;

a step of forming imagewise an electrostatic latent image on a photoconductive element;

a step of developing said latent image with a color toner bearing an electrostatic charge thereon, said color toner comprising a polyester resin obtained by polymerizing by condensation polymerization (a) a diol component comprising a mixture of diols expressed in terms of General Formula (1):

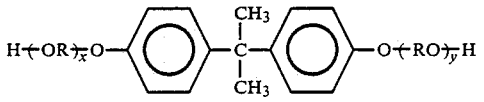

wherein, R is an ethylene group or a propylene group, and x and y respectively represent integers provided that the average of the total sum of x and y falls within a range of 2 to 7, and (b) a mixture of acid components comprising an aliphatic unsaturated dicarboxylic acid, an acid anhydride thereof or a derivative thereof and a polybasic carboxylic acid having not less than three carboxylic acid groups or an acid anhydride thereof, the proportion of the content of said polybasic carboxylic acid having not less than three carboxylic acid groups or the acid anhydride thereof to the total acid components being not less than 5 mol % and less than 30 mol %; and a chromatic coloring agent;

a step of transferring said developed image to a recording sheet; and a step of bringing said toner image formed on the recording sheet into contact With a heated roller under pressure.

DETAILED DESCRIPTION OF THE INVENTION

The developer composition for developing an electrostatic latent image can exhibit the function and effect as described below.

In component (b) for forming the polyester resin contained in the toner as a binder, the proportion of the polybasic carboxylic acid having not less than three carboxylic acid groups or an acid anhydride thereof is not less than 5 mol % and less than 30 mol %. Accordingly, there may remain less unreacted carboxyl groups in the resulting polyester resin, and, as a result, the stability of an electrical charge quantity to the humidity can be greatly improved in the toner to make small the environment dependency of the image density. Moreover, the presence of component (b) makes it possible to achieve an appropriately large viscoelasticity of the polyester resin at the time of fusing. Thus, a sufficient anti-offset property can be assured in the toner.

In addition, since in the above component (b) an aliphatic unsaturated dicarboxylic acid, an acid anhydride thereof or a derivative thereof is used as the component of a carboxylic acid having two carboxylic acid groups, the glass transItIon poInt of the resulting polyester resin can be of appropriate height, so that sufficient fixing can be achieved even When the pressure by the heated roller is small and the contact time with the heated roller is short as in the case where the fixing is carried out at high speed. Further, when the image formation is continuously carried out over a number of times, there may be caused a phenomenon that the temperature of the heated roller may be lowered by being absorbed to an image support such as transfer paper, but, even in such a case, a sufficient low temperature fixing performance can be achieved.

Further, if in component (b) an aliphatic saturated dicarboxylic acid, an acid anhydride thereof or a derivative thereof is used in place of the aliphatic unsaturated dicarboxylic acid, an acid anhydride thereof or a derivative thereof, the glass transition point of the resulting polyester resin may be considerably greatly lowered to cause a problem that an anti-blocking property of a toner is lowered. However, since the aliphatic unsaturated dicarboxylic acid, an acid anhydride thereof or a derivative thereof is used in the present invention, the glass transition point of the resulting polyester resin can be of an appropriate height, Whereby the anti-blocking property of the toner can be sufficiently assured.

Still further, when taking the constitution in which a releasing agent is contained in the toner, an anti-offset property owing to the releasing agent can be imparted to the toner, whereby a toner having a better anti-offset property can be obtained. Also, in a color toner, a chromatic coloring agent dispersed in a binder can be finely grounded only with difficulty in general, as compared With carbon black used in a black toner. For this reason, the toner particles may be of, so to speak, coarse grain, resulting in poorer smoothness of the surface of a fixed image of a color toner than the black toner to raise a problem that the fixed image may be readily damaged by a mechanical external force such as rubbing. However, the smoothness of the surface of a fixed image can be improved by incorporating the releasing agent into the color toner, whereby it is made possible to form a good fixed image.

In addition, the color toner using as a binder the polyester resin as mentioned above is usually strongly inclined to be negatively charged and it is difficult to use it as a positively chargeable toner. However, since in the present invention a resin coated carrier comprising a resin layer containing a fluorine containing resin is used as a carrier, the color toner can be triboelectrically charged to a positive polarity, and moreover the charge quantity can be controlled to an appropriate level. Accordingly, there can be obtained a fog-free stable color image even when the color toner is used as a positively chargeable one As a result, it becomes unnecessary for the color toner to particularly contain any electrical charge controlling agent, thus preventing the problem of causing a lowering of color tone that tends to occur when an electric charge controlling agent is contained.

The present invention will be described below in detail.

According to a most preferred embodiment of the present invention, the toner used in the present invention is constituted of powder of fine particles, basically comprising the polyester resin, used as a binder, obtained by condensation polymerization of the above component (a) and component (b), which binder contains carbon black when used as an ordinary toner or a chromatic coloring agent when used as a color toner, and more preferably further contains a releasing agent or optionally contains other additives. Also, the toner may be constituted of the powder of fine particles to which additives such as a fluidity improver are optionally added and mixed. And, a resin layer containing a fluorine-containing resin is provided on the surface of a core material for a carrier to constitute a resin coated carrier, and these toner and resin coated carrier constitutes a developer composition.

First, the toner which is a component constituting the developer composition of the present invention will be described below.

The above component (a) is the diol component represented by General Formula (1) as mentioned above, and is a component constituting the main body of a basic skeleton (a backbone chain) of polyester resin together with an aliphatic unsaturated dicarboxylic acid which will be described hereinbelow in detail.

As such a diol component, there can be used, for example, polyoxypropylene(2.2)- 2,2-bis(4-hydroxyphenyl)propane, polyoxypropylene(3.3)-2,2 -bis(4-hydroxyphenyl)propane, polyoxyethylene(2.0)-2,2-bis(4-hydroxyphenyl)propane, polyoxypropylene(2.0) polyoxyethylene(2.0)-polyoxyethylene(2.0)-2,2-bis(4-hydroxyphenyl)propane, etc.

The above component (b) is a mixture of acid components comprising an aliphatic unsaturated dicarboxylic acid, an acid anhydride thereof or a derivative thereof which is a component constituting the main body of a basic skeleton (a backbone chain) of polyester resin together with the diol component of the above component (a), and a polybasic carboxylic acid having not less than three carboxylic acid groups or an acid anhydride thereof Which is a component for making a cross-linked polyester resin. In the present invention, the proportion of the content of said polybasic carboxylic acid having not less than three carboxylic acid groups or an acid anhydride thereof to the total acid components is required to be not less than 5 mol % and less than 30 mol %, more preferably, not more than 27mol %.

The proportion less than 5 mol %, of the content of said polybasic carboxylic acid having not less than three carboxylic acid groups or an acid anhydride thereof to the total acid components, may result in an insufficient anti-offset property of the toner to make unclear the image to be obtained. On the other hand, the proportion more than 30 mol %, of the above content to the total acid components may cause a great change in the electrical charge quantity of the toner due to humidity, to make large the environment dependency of the image density and make it difficult to form a stable image.

Also, in the above component (b), as the dicarboxylic acid component, an aliphatic unsaturated dicarboxylic acid, an acid anhydride thereof or a derivative thereof is used as an essential component, whereby a sufficient anti-blocking property in the toner can be ensured. In contrast thereto, if an aliphatic saturated dicarboxylic acid, an acid anhydride thereof or a derivative thereof is used in place of the aliphatic unsaturated dicarboxylic acid, an acid anhydride thereof or a derivative thereof, the glass transition point of the resulting polyester resin may be considerably lowered to worsen the anti-blocking property of the toner.

As the aliphatic unsaturated dicarboxylic acid, an acid anhydride thereof or a derivative thereof in the above component (b), there can be used, for example, fumaric acid, maleic acid, citraconic acid, mesaconic acid, itaconic acid, glutaconic acid, anhydrides or acid halides of these, lower alkyl esters of these acids, etc.

As the polybasic carboxylic acid having not less than three carboxylic acid groups or an acid anhydride thereof in the above component (b), there can be used, for example, 1,2,4-benezenetricarboxylic acid, 1,3,5 -benzenetricarboxylic acid, 1,2,4-cyclohexanetricarboxylic acid, 2,5,7-naphthalenetricarboxylic acid, 1,2,4-naphthalenetricarboxylic acid, 1,3,4-butanetricarboxylic acid, 1,2,5 -hexanetricarboxylic acid, 1,3 -dicarboxy-2-methyl-2-methylcarboxypropane, 1,3-dicarboxy-2-methyl-2-carboxymethylpropane, tetra(caroboxymethyl)methane, 1,2,7,8-octanetetracarboxylic acid, Empol trimer acids, anhydrides of these acids, etc. Of these, particularly preferably usable is 1,2,4-benezenetricarboxylic acid.

In the present invention, a particular polyester resin as mentioned above is used as a binder, but a resin obtained by adding an additional resin to the above polyester resin can be also used as a binder.

A chromatic coloring agent is contained in the toner as an essential component when the toner constituting the developer composition of the present invention is used as a color toner.

As the coloring agent, there can be used various organic or inorganic chromatic dyes or various chromatic pigments, but preferred are organic chromatic pigments having a sharp color and having a high light resistance and opecifying property. More specifically, there can be used, for example, those exemplified below. The exemplary materials shown below are expressed in terms of C.I. number disclosed in Color Index, Third Ed., 1971 and Color Index, Revised and Enlarged Ed., 1975, and an example of a trade name corresponding thereto.

C.I. Pigment Red 5
(Permanent Carmine FB; available from Hoechst Japan Co.)
C.I. Pigment Red 48:1
(Sumicaprint Red C; available from Sumitomo Chemical Co., Ltd.)
C.I Pigment Red 53:1
(Chromophthal Magenta G; available from Ciba Geigy Corp.)
C.I. Pigment Red 57:1
(Sumicaprint Carmine 6BC; available from Sumitomo Chemical Co. Ltd.)
C.I. Pigment Red 123
(Kayaset Red E-B; available from Nippon Kayaku Co., Ltd.)
C.I. Pigment Red 139
(Kayaset Red E-GR; available from Nippon Kayaku Co., Ltd.)
C.I. Pigment Red 144
(Chromophthal Red BRN; available from Ciba Geigy Corp.)
C.I. Pigment Red 149
(PV Fast Red B; available from Hoechst Japan Co.)
C.I. Pigment Red 166
(Chromophthal Red R; available from Ciba Geigy Corp.)
C.I. Pigment Red 177
(Chromophthal Red A3B; available from Ciba Geigy Corp.)

C.I. Pigment Red 178
(Kayaset Red E-GG; available from Nippon Kayaku Co., Ltd.)
C.I. Pigment Red 222
(Chromophthal Red Magenta G; available from Ciba Geigy Corp.)
C.I. Pigment Orange 31
(Chromophthal Orange 4R; available from Ciba Geigy Corp.)
C.I. Pigment Orange 43
(Hostaperm Orange GR; available from Hoechst Japan Co.)
C.I. Pigment Yellow 17
(Fast yellow GBFN; available from Sumitomo Chemical Co., Ltd.)
C.I. Pigment yellow 14
(Benzidine yellow OT; available from DuPont Co.)
C.I. Pigment yellow 138
(Falictol yellow L0960HD; available from BASF Corp.)
C.I. Pigment yellow 93
(Chromophthal yellow 3G; available from Ciba Geigy Corp.)
C.I. Pigment yellow 94
(Chromophthal yellow 6G; available from Ciba Geigy Corp.)
C.I. Pigment Green 7
(Chromophthal Green GF; available from Ciba Geigy Corp.)
C.I. Pigment Green 36
(Cyanine Green S537-2Y; available from Dainichiseika Color & Chemicals Mfg. Co., Ltd.)
C.I. Pigment Blue 15:3
(Cyanine Blue A330; available from Sanyo Color Works, Ltd.)
C.I. Pigment Blue 60
(Chromophthal Blue A3R; available from Ciba Geigy Corp.)
C.I. Pigment Violet 23
(Sumicaprint Fast violet RLN; available from Sumitomo Chemical Co., Ltd.)

If necessary, inorganic pigments such as red ion oxide, titanium oxide and carbon black can be used in combination, together With the above materials.

As the chromatic dye, there can be used, for example, azo dyes, anthraquinone dyes, indigoido dyes, quinoneimine dyes, phthalocyanine dyes, etc.

These chromatic coloring agents can be used alone or in combination of two or more ones, and may be used in an amount of 3 to 20 parts by weight based on 100 parts by weight of the binder of the toner. When used in an excessively small amount, the chromaticity may be too low to readily obtain a sufficiently chromatic color image, and, on the other hand, when used in an excessively large amount, the fixing insufficiency may sometimes be caused.

The color toner constituting the color developer composition of the present invention may optionally contain various additives.

In the present invention, a releasing agent can be used as a preferable additive. As the releasing agent, there can be used, for example, polyolefin wax, aliphatic acid metal salts, aliphatic acid esters, partially saponified aliphatic acid esters, higher aliphatic acids, higher alcohols, fluid or solid paraffin wax, amide type wax, polyhydric alcohol esters, silicone varnish, aliphatic fluorocarbon, etc. These releasing agents may be used alone or as a mixture of two or more ones.

In the present invention, polyolefin wax can be particularly preferably used as the releasing agent. Such polyolefin wax may be any of unmodified polyolefin wax and modified polyolefin wax in which the modified component is in the form of a block or graft with respect to the olefin component.

The olefin component of the unmodified polyolefin wax or modified polyolefin wax may be any of a homopolymer type obtainable from a singular olefin monomer and a copolymer type obtainable by copolymerizing an olefin monomer with an additional monomer copolymerizable with this monomer.

As the above olefin monomer, there can be used, for example, ethylene, propylene, butene-1, pentene-1, hexene-1, heptene-1, octene- 1, nonene-1, decene-1, or isomers of these having different positions for unsaturated bonds, those having a branched chain comprising an alkyl group such as 3-methyl-1-butene, 3-methyl-1-pentene, 3-propyl 5-methyl-2-hexane, and all other olefin monomers.

As the additional monomer copolymerizable with the olefin monomer, there can be variously used, besides olefin monomers other than the above, vinyl ethers including, for example, vinyl methyl ether, vinyl-n butyl ether, vinyl phenyl ether, etc.; vinyl esters including, for example, vinyl acetate, vinyl butylate, etc.; haloolefins including, for example, vinyl fluoride, vinylidene fluoride, tetrafluoroethylene, vinyl chloride, vinylidene chloride, tetrachloroethylene, etc.; acrylates or methacrylates including, for example, methyl acrylate, ethyl acrylate, n-butyl acrylate, methyl methacrylate, ethyl methacrylate, n-butyl methacrylate, stearyl methacrylate, N,N-dimethylaminoethyl methacrylate, t-butylaminoethyl methacrylate, etc.; acrylic acid derivatives including, for example, acrylonitrile, N,N-dimethylacrylamide, etc.; organic acids including, for example, acrylic acid, methacrylic acid, maleic acid, fumaric acid, itaconic acid, etc.; diethyl fumarate, betapinene, etc.

When the copolymer type is used as the olefin component, it may include olefin copolymer types obtained by copolymerizing at least two of the olefin monomers as listed above, for example, an ethylene/propylene copolymer, an ethylene/butene copolymer, an ethylene/pentene copolymer, a propylene/butene copolymer, propylene/pentene copolymer, an ethylene/3-methyl-1-butene copolymer, an ethylene/propylene/-butene copolymer, etc.; and olefin copolymer types obtained by copolymerizing at least one of the olefin monomers as listed above with at least one of monomers other than the olefin monomers as listed above, for example, an ethylene/vinyl acetate copolymer, an ethylene/vinyl methyl ether copolymer, an ethylene/-vinyl chloride copolymer, an ethylene/methyl acrylate copolymer, an ethylene/methyl methacrylate copolymer, and ethylene/acrylic acid copolymer, a propylene/vinyl acetate copolymer, a propylene/vinyl ethyl ether copolymer, a propylene/ethyl acrylate copolymer, a propylene/methacrylic acid copolymer, a butene/vinyl methyl ether copolymer, a butene/methyl methacrylate copolymer, a pentene/vinyl acetate copolymer, a hexene/vinyl butylate copolymer, an ethylene/propylene/vinyl acetate copolymer, an ethylene/vinyl acetate/vinyl methyl ether copolymer, etc.

When monomers other than olefin monomer are used to give the copolymer types, the proportion of the olefin moiety composed of an olefin monomer in the polyolefin component should preferably be 50 mol % or more. An excessively small proportion of the olefin moiety may sometimes result in no sufficient releasing property at low temperature.

As the modifying component in the modified polyolefin wax, there can be preferably used aromatic vinyl monomers, α-methylene aliphatic monocarboxylic acid ester monomers, etc.

As the above-mentioned aromatic vinyl monomers, there can be preferably used styrene monomers including, for example, styrene, o-methylstyrene, m-methylstyrene, p-methylstyrene, α-methylstyrene, p-ethylstyrene, 2,4 -dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylystyrene, p-chlorostyrene, 3,4 -dichlorostyrene, etc.

As the above mentioned α-methylene aliphatic monocarboxylic acid ester monomers, there can be preferably used, for example, methyl acrylate, ethyl acrylate, n-methyl acrylate, isobutyl acrylate, propyl acrylate, n-octyl acrylate, dodecyl acrylate, lauryl acrylate, 2-ethylhexyl acrylate, stearyl acrylate, 2 -chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2 -ethylhexyl methacrylate, stearyl methacrylate, phenyl methacrylate, dimethylaminoethyl methacrylate, diethylaminoethyl methacrylate, etc.

When the above aromatic vinyl monomer is used as the modifying component, the proportion of said modifying component to the modified polyolefin should preferably be 0.1 to 15% by weight, particularly preferably 1 to 10% by weight. When the α-methylene aliphatic monocarboxylic acid ester monomer is used as the modifying component, the proportion of said modifying component to the modified polyolefin should preferably be 0.1 to 50% by weight, particularly preferably 1 to 40% by Weight.

Such unmodified polyolefin wax or modified polyolefin wax may preferably have a lower softening point in itself, for example, may preferably have a softening point of 80° to 180° C., particularly 90° to 160° C., when measured according to the ring and ball method as defined in JIS K 2531-1960.

Commercially available polyolefin wax may include, for example, the following, which can be preferably used in the present invention.

"Viscol 660P" (available from Sanyo Chemical Industries, Ltd.)

"Viscol 550P" (available from Sanyo Chemical Industries, Ltd.)

"Polyethylene 6A" (available from Allied Chemical Corp.)

"Hi-wax 400P" (available from Mitsui Petrochemical Industries, Ltd )

"Hi-wax 100P" (available from Mitsui Petrochemical Industries, Ltd.)

"Hi-wax 200P" (available from Mitsui Petrochemical Industries, Ltd.)

"Hi-wax 320P" (available from Mitsui Petrochemical Industries, Ltd.)

"Hi-wax 220P" (available from Mitsui Petrochemical Industries, Ltd.)

"Hi-wax 2203A" (available from Mitsui Petrochemical Industries, Ltd.)

"Hi-wax 4202 E" (available from Mitsui Petrochemical Industries, Ltd.)

"Hoechst Wax PE 520" (available from Hoechst Japan Co.)

"Hoechst Wax PE 130" (available from Hoechst Japan Co.)

"Hoechst Wax PE 190" (available from Hoechst Japan Co.)

Besides these commercial goods, there can be also for example, polyethylene wax subjected to block copolymerization or graft copolymerization with methyl methacrylate, polyethylene wax subjected to block copolymerization or graft copolymerization with butyl methacrylate, polyethylene wax subjected to block copolymerization or graft copolymerization with styrene, etc.

The proportion of the content of polyolefin wax to the binder may preferably be 1 to 20% by weight. Controlling the proportion in such a preferable range makes it possible to sufficiently exhibit the function of polyolefin wax as a releasing agent without worsening various properties of the toner.

As the aforesaid aliphatic acid metal salt, there can be used, for example, metal salts of maleic acid with zinc, magnesium, calcium, etc.; metal salts of stearic acid with zinc, cadmium, barium, lead, iron, nickel, cobalt, copper, aluminum, magnesium, etc.; dibasic lead stearate; metal salts of oleic acid with zinc, magnesium, iron, cobalt, copper, lead, calcium, etc.; metal salts of palmitic acid with aluminum, calcium, etc.; lead caprylate; lead caproate, metal salts of linolic acid with zinc, cobalt, etc.; calcium ricinolate; metal salts of ricinoleic acid with zinc, cadmium, etc.; and a mixture of any of these; etc.

As the aforesaid aliphatic acid ester, there can be used, for example, ethyl maleate, butyl maleate, methyl stearate, butyl stearate, cetyl palmitate, ethylene glycol montanate, etc.

As the aforesaid partially saponified aliphatic acid ester, there can be used, for example, a calcium part saponified montanic acid ester.

As the aforesaid higher aliphatic acid, there can be used, for example, dodeoaic acid, lauric acid, myristic acid, palmitic acid, stearic acid, oleic acid, linolic acid, ricinolic acid, arachic acid, behenic acid, lignoceric acid, selacholeic acid, and a mixture of any of these, etc.

As the aforesaid higher alcohol, there can be used, for example, dodecoyl alcohol, lauryl alcohol, myristyl alcohol, palmityl alcohol, stearyl alcohol, alakyl alcohol, behenyl alcohol, etc.

As the aforesaid paraffin wax, there can be used, for example, natural paraffin, microcrystalline wax, synthetic paraffin, chlorinated hydrocarbon, etc.

As the aforesaid amide type wax, there can be used, for example, stearic acid amide, oleic acid amide, palmitic acid amide, lauric acid amide, behenic acid amide, methylenebisstearoamide, ethylenebisstearoamide, etc.

As the aforesaid polyhydric alcohol ester, there can be used, for example, glycerol stearate, glycerol ricinolate, glycerol monobehenate, sorbitan monostearate, propylene glycol monostearate, sorbitan triolate, etc.

As the aforesaid silicone varnish, there can be used, for example, methylsilicone varnish, phenylsilicone varnish, etc.

As the aforesaid fluorocarbon, there can be used, for example, oligomer compounds of ethylene tetrafluoride or propylene hexafluoride, fluorine-containing surface active agents disclosed in Japanese Patent O.P.I. Publication No. 124428/1978, etc.

The proportion of these releasing agents to the binder of the toner may preferably be 1 to 20% by weight.

The additives that may be optionally contained in the color toner used in the present invention may include, for example, a fluidity improver, a lubricant, an electrical charge controlling agent, etc.

As the fluidity improver, there can be used particles of silica, alumina, titania, etc., and particularly preferred is one having been subjected to a treatment to make such particles hydrophobic (hereinafter referred to as "hydrophobization treatment"). Specifically, preferred is one having hydrophobization percentage of 30% or more, particularly preferably 50% or more. Here, "hydrophobization" is meant to break the hydroxyl groups bonded to silica or the like, and this can be effected by reacting dialkyldihalogenated silane, trialkylhalogenated silane, alkylhalogenated silane, hexaalkyl disilane, etc. with silica or the like at a high temperature. The fluidity improver may preferably have an average particle size of 1 μm or less, particularly preferably 0.5 μm or less. Also, the fluidity improver may preferably be used in such a state that it has been adhered or tacked on the surface of a toner particle, and may be added preferably in an amount of 0.01to 10% by weight, particularly preferably 0.05 to 5% by weight based on the total amount of the toner.

As the lubricant, there can be used, for example, zinc stearate, lithium stearate, sodium stearate, stearic acid, hardened castor oil, etc. This lubricant may be added preferably in an amount of 0.01 to 2% by weight, based on the total amount of the toner.

As the electrical charge controlling agent, a negatively chargeable one may include 2:1 type metal-containing azo dyes disclosed, for example, in Japanese Patent O.P.I. Publication No. 141452/1982, Japanese Patent O.P.I Publication No. 7645/1983, Japanese Patent O.P.I. Publication No. 111049/1983, Japanese Patent O.P.I. Publication No. 185653/1983, Japanese Patent O.P.I. Publication No. 167033/1982, Japanese Patent Publication No. 6397/1969, etc; metal complexes of aromatic oxycarboxylic acids or aromatic dicarboxylic acids disclosed, for example, in Japanese Patent O.P.I. Publication No. 104940/1982, Japanese Patent O.P.I. Publication No. 111541/1982, Japanese Patent O.P.I. Publication No. 124357/1982, Japanese Patent O.P.I. Publication No. 127726/1978, etc.; sulfonylamine derivatives of copper phthalocyanine dyes or sulfonamide derivative dyes of copper phthalocyanine, and sulfonamide, sulfonic acid or sulfonate derivative dyes of copper phthalocyanine disclosed, for example, in Japanese Patent O.P.I. Publication No. 45931/1977; etc., and a positively chargeable one may include quaternary ammonium compounds disclosed, for example, in Japanese Patent O.P.I. Publication No.51951/1974, Japanese Patent O.P.I. Publication No. 10141/1977, etc.; alkyl pyridinium compounds or alkyl picolinium compounds disclosed, for example, in Japanese Patent O.P.I Publication No. 11461/1981, Japanese Patent O.P.I. Publication No. 158932/1979, U.S. Pat. No. 4,254,205, etc.; Nigrosine dyes, for example, Nigrosine SO, Nigrosine EX, etc ; additIon condenstates disclosed, for example, in Japanese Patent Publication No. 80320/1974, etc.

When a magnetic toner is constituted, a magnetic material is usually contained in the binder. As the magnetic material, there can be used metals such as iron, cobalt, nickel, etc. Which are ferromagnetIc, alloys thereof or oompounds containing any of these elements, including ferrite and magnetite, or alloys containing no ferromagnetic elements but capable of turning ferromagnetic by application of suitable heat treatment, for example, alloys called Heusler's alloy containing manganese and copper, such as manganese-copper-aluminum and manganese-copper tin, or chromium dioxide and others. These magnetic materials may preferably be uniformly dispersed in the binder in the form of fine particles having an average particle size of 0.to 1 μm. The proportion of the content of the magnetic materials may be preferably 20 to 70 parts by weight, particularly preferably 30 to 60 parts by weight, based on 100 parts by weight of the toner.

The color toner used in the present invention may also contain a property improver to impart various properties. As the property improver, there can be used, for example, resins which are uncrosslinked polymers and do not contain any chloroform insoluble matter. Specifically, there can be used, for example, homopolymers or copolymers obtained by polymerizing monomers such as styrenes, vinyl esters, methylene aliphatic carboxylic esters, acrylic esters, vinyl ethers, vinyl ketones and N-vinyl compounds, or a mixture of these homopolymers or copolymers, or, alternatively, non-vinyl resins such as rosin modified phenol formalin resins, oil modified epoxy resins, polyurethane resins, cellulose resins and polyether resins, or a mixture of these with the above vinyl resins. These resins may be contained in the range that may not inhibit the effect obtainable by the present invention, for example, in the proportion of 90% by weight or less to the binder.

The resin coated carrier constituting the developer composition of the present invention will be described below.

The resin coated carrier used in the present invention comprises a resin layer containing a fluorine-containing resin, provided on the surface of a core material of the carrier.

As the fluorine-containing resin, there is no particular limitation, but can be preferably used, for example, a vinylidene fluoride/ethylene tetrafluoride copolymer and a polymer obtained by using as a monomer component an acrylate having a group substituted with a fluorine atom at the side chain (hereinafter referred to also as "fluorine-containing acrylic polymer").

The above vinylidene fluoride/ethylene tetrafluoride copolymer may preferably include copolymers having a copolymerization molar ratio ranging between 75:25 and 95:5, particularly preferably ranging between 75:25 and 87.5 and 12.5. By using the copolymers within the above range, the copolymers can be made readily soluble in a solvent in preparing a coating solution used for the formation of the resin layer to make it easy to prepare the coating solution, and also make it possible to obtain a resin coated carrier having large mechanical strength of the resulting resin layer and having good durability.

However, since, even if the solubility to the solvent is high, the viscosity of the coating solution may increase When the molecular weight of the fluorine-containing resin is excessively large, it sometimes occur that a uniform resin layer can be formed only with difficulty, pin holes are generated, or the durability is lowered. On the other hand, when the molecular weight of the fluorine-containing resin is excessively small, there may be often caused a problem such that the mechanical strength of the resin layer is lowered. For these reasons, in the present invention, preferably usable is a fluorine-containing resin having intrinsic viscosity (in methyl ethyl ketone, 30° C.), which is a standard of the molecular weight, ranging between 0.1 dl/g and 5 dl/g Also, as the acrylate monomer having a group substituted with a fluorine atom at the side chain, which is used for forming the above fluorine-containing acrylic polymer, there can be preferably used the monomer represented by General Formula (i) shown below. General Formula (i):

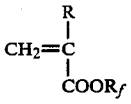

wherein R represents a hydrogen atom or a methyl group, and $R_f$ represents an alkyl group or aralkyl group substituted with at least one fluorine atom.

Of the monomer represented by the above General Formula (i), more preferable monomer may include the monomer represented by General Formula (ii) or (iii) shown below.

General Formula (ii):

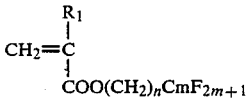

General Formula (iii):

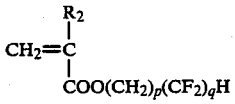

wherein $R_1$ and $R_2$ each represent a hydrogen atom or a methyl group, n and p each represent an integer of 1 to 3, and m and q each represent an integer of 1 to 19.

Of these monomers represented by General Formulas (ii) and (iii), further more preferable monomer may include the monomer represented by General Formula (iv) or (v) shown below.

General Formula (iv):

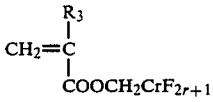

General Formula (v):

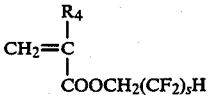

wherein $R_3$ and R4 each represent a hydrogen atom or a methyl group, r represents 1 or 2, and s represents an integer of 2 to 4.

As specific exemplary compounds for the above acrylate monomer having a group substituted with a fluorine atom at the side chain, there can be used, for example, acrylic acid-1,1-dihydroperfluoroethyl, acrylic acid-1,1-dihydroperfluoro-n-propyl, acrylic acid 1,1,3 -trihydroperfluoro-n-propyl, acrylic acid-1,1,5-trihydroperfluoro-n-butyl, acrylic acid-1,1,5-trihydroperfluoro-n-amyl, methacrylic acid 1,1-dihydroperfluoroethyl, methacrylic acid-1,1-dihydroperfluoro-n-propyl, methacrylic acid-1,1,3-trihydroperfluoro-n-propyl, methacrylic acid-1,1,5-trihydroperfluoro-n-butyl, methacrylic acid 1,1,5 -trihydroperfluoro-n-amyl, etc.

To form the above fluorine-containing acrylic polymer, an additional monomer component may be used in addition to the monomer component as described above. Such an additional monomer component may include, for example, acrylic acid, methyl acrylate, ethyl acrylate, butyl acrylate, benzyl acrylate, acrylic acid amide, cyclohexyl acrylate, glycidyl acrylate, hydroxyethyl acrylate, methacrylic acid, methyl methacrylate, ethyl methacrylate, butyl methacrylate, benzyl methacrylate, methacrylic acid amide, cyclohexyl methacrylate, glycidyl methacrylate, hydroxyethyl methacrylate, styrene, vinyl acetate, ethylene, propylene, isoprene, etc.

Specific exemplary compounds of the above fluorine-containing acrylic polymer may include those represented by the structural formulas shown below, but by no means limited to these.

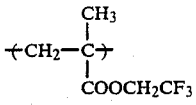
Polymer (1)

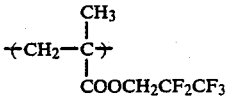
Polymer (2)

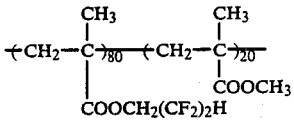
Polymer (3)

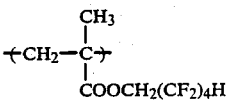
Polymer (4)

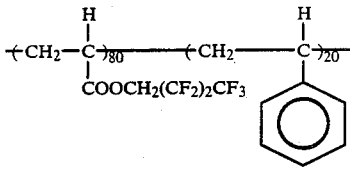
Polymer (5)

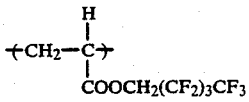
Polymer (6)

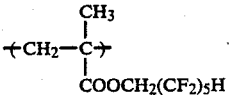
Polymer (7)

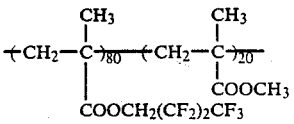
Polymer (8)

-continued

Polymer (9)

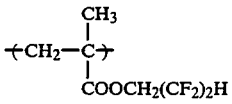

Polymer (10)

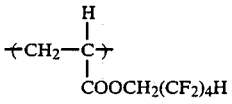

Polymer (11)

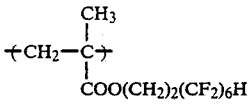

Polymer (12)

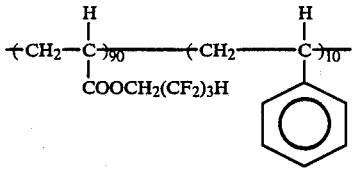

Polymer (13)

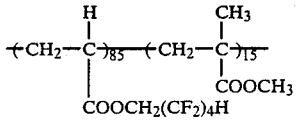

Polymer (14)

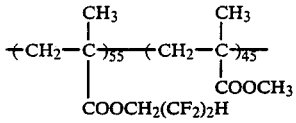

Polymer (15)

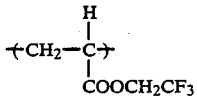

Polymer (16)

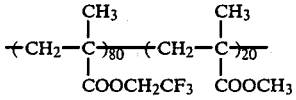

Polymer (17)

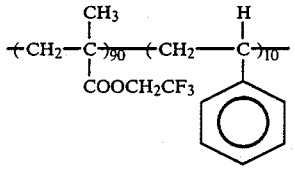

Polymer (18)

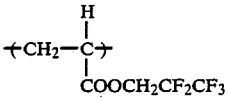

Polymer (19)

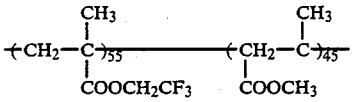

Polymer (20)

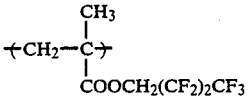

Polymer (21)

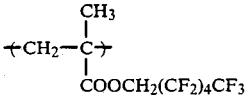

-continued

Polymer (22)

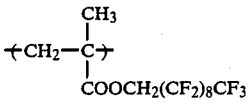

Polymer (23)

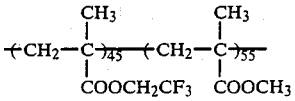

Polymer (24)

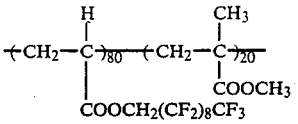

To form the resin layer, the vinylidene fluoride/ethylene tetrafluoride copolymer or the above fluorine-containing acrylic polymer may each be used alone or a blend of these may be used.

A blend with a further additional polymer may be also used, and, in such an instance, the additional polymer should preferably be compatible with the vinylidene fluoride/ethylene tetrafluoride copolymer and/or the above fluorine-containing acrylic polymer to be blended therewith.

Such an additional polymer may preferably have a function of improving the adhesion between the carrier core material and the resin layer. As a such a kind of polymer, there can be preferably used, for example, a methyl methacrylate copolymer. When said additional polymer is blended for use, the vinylidene fluoride-/ethylene tetrafluoride copolymer and/or the above fluorine containing acrylic polymer which is/are blended therewith may preferably be used in the blending proportion of 50 to 90% by weight, and the additional polymer, of 50 to 10% by weight. Use of the additional polymer in an excessive blending proportion may sometimes cause a loWering of the compatibility between the resins to make ununiform the electrical charge quantity and lower the electrical charge quantity.

The resin layer of the resin coated carrier used in the present invention can be formed, for example, in the following manner: A solution obtained by dissolving the fluorine containing resin in a solvent or a solution obtained by dissolving the further additional polymer is coated on the surface of the carrier core material according to, for example, a process such as a dip process, a dry spray process or a fluidized bed process, followed by curing of the resulting coating by, for example, heating or standing to form the resin layer.

To describe more specifically, taking an example where the resin layer is formed by the fluidized bed process, the resin layer can be formed by use of a fluidized bed coating apparatus in the following manner: A carrier core material is risen to the height at which it is balanced, and spray coating of a coating solution is continued until the carrier core material again falls. Coating like this may be repeatedly carried out, thereby forming the resin layer. In this instance, once an agglomerate of the carrier Was formed, sifting may be carried out by any suitable means, whereby a resin coated carrier having a resin layer of an appropriate thickness can be obtained.

An additional additive may be optionally added to the coating solution used for forming the resin layer. As for the solvent, there is no particular limitation thereto so long as it can dissolve the fluorine containing resin and the additional polymer further added, and can be used solvents including, for example, ketones such as acetone and methyl ethyl ketone, tetrahydrofuran, dioxane, dimethylsulfoxide, hydrocarbon compounds having fluorine-and/or halogen-substituted group(s), or a solvent comprising a mixture of any of these.

The resin layer thus formed may preferably have a thickness of, for example, 0.05 to 20 μm, more preferably 0.1 to 3 μm.

As the carrier core material for the resin coated carrier, there can be used the materials such as sand, glass or metals which have been conventionally used as a carrier material. Of these, materials that can be particularly preferably used are particles comprising a substance strongly magnetizable by a magnetic field in the direction thereof, for example, ferromagnetic metals including ferrite and magnetite, as well as iron, nickel, cobalt, etc., or alloys or compounds containing these metals, or alloys containing no ferromagnetic elements but capable of turning ferromagnetic by application of suitable heat treatment, for example, alloys called Heusler's alloy containing manganese and copper, such as manganese-copper-aluminum and manganese-copper-tin, or chromium dioxide and others.

The resin coated carrier used in the present invention may preferably a weight average particle size of 10 to 1,000 μm, particularly preferably 20 to 300 μm. It may also preferably include those which can give a positive charge of 5 to 40 nC/g under a usual use condition, to the aforesaid color toner used in combination with the resin coated carrier.

According to the developer composition of the present invention, image formation can be achieved by application of various development processes. Specifically, there can be applied, for example, (a) the contact type magnetic brush process in which a magnetic brush of a color developer is supported on a color developer-transporting member, for example, in such a state that the layer thickness is larger than the gap in the developing area, and this magnetic brush is carried into the developing area, where the toner particle or particles in the magnetic brush is/are adhered to an electrostatic latent image while rubbing the electrostatic latent image with the magnetic brush, to carry out the development, (b) the jumping magnetic brush process in which a magnetic brush of a one component type or two component type developer is supported on a developer-transporting member, for example, in such a state that the layer thickness is larger than the gap in the developing area, and this magnetic brush is carried into the developing area and at the same time, for example, a oscillating electric field or the like is acted on the developing area, whereby the toner particle or particles is/are adhered to an electrostatic latent image while flying the toner particle or particles in the magnetic brush, (c) the cascade process, etc.

EXAMPLES

Specific examples of the present invention will be described below, but the present invention is by no means limited to these examples.

Production of binder resin (1) Resin A (for the present invention):

| | |
|---|---|
| Polyoxypropylene(2,2)-2,2-bis-(4-hydroxyphenyl)propane | 490 g (1.42 mols) |
| Polyoxyethylene(2,0)-2,2-bis(4-hydroxy-phenyl)propane | 193 g (0.61 mol) |
| Fumaric acid | 202 g (1.74 mols) |
| Diisopropyl orthotitanate (Esterified catalyst) | 0.8 g |

The above materials were put into a round bottom flask of 1 lit. volume, equipped with a thermometer, a stirrer made of stainless steel, a nitrogen gas introducing pipe made of glass and a falling system condenser, and this flask Was set on a mantle heater, into which nitrogen gas was introduced from the nitrogen gas introducing pipe to keep the inside of the flask to an inert atmosphere. Under such a state, temperature was raised to 230° C. to carry out the reaction with stirring. At the time when the water formed by the reaction no longer flowed out, the acid value was measured to find to be 1.5.

Further, 37 g (0.19 mol) of an anhydride of 1,2,4-benzenetricarboxylic acid was added to carry out the reaction over a period of about 8 hours, and the reaction was stopped at the time when the acid value reached 19.

The resulting resin is designated as "Resin A". This Resin A was in the form of a pale yellow solid, and the softening point of Resin A was measured by use of Flowtester CFT-500 (produced by Shimadzu Corp.) to find to be 130° C.

(2) Resin B (for the present invention):

| | |
|---|---|
| Polyoxypropylene(2,2)-2,2-bis-(4-hydroxyphenyl)propane | 490 g (1.42 mols) |
| Polyoxyethylene(2,0)-2,2-bis(4-hydroxy-phenyl)propane | 193 g (0.61 mol) |
| Fumaric acid | 157 g (1.35 mols) |
| Diisopropyl orthotitnate (Esterified catalyst) | 0.8 g |

The above materials were reacted in the same manner as in the production of Resin A, and 86 g (0.45 mol) of an anhydride of 1,2,4-benzenetricarboxylic acid were further added to carry out the reaction, which reaction was stopped at the time when the acid value reached 22.

The resulting resin is designated as "Resin B". This Resin B was in the form of a pale yellow solid, and the softening point of Resin B was measured in the same manner as for Resin A to find to be 130° C.

(3) Resin C (for the present invention):

| | |
|---|---|
| Polyoxypropylene(2,2)-2,2 bis-(4-hydroxyphenyl)propane | 490 g (1.42 mols) |
| Polyoxyethylene(2,0)-2,2-bis(4-hydroxy-phenyl)propane | 193 g (0.61 mol) |
| Mesaconic acid | 191 g (1.47 mols) |
| Diisopropyl orthotitanate (Esterified catalyst) | 0.8 g |

The above materials were reacted in the same manner as in the production of Resin A, and 71 g (0.37 mol) of an anhydride of 1,2,4-benzenetricarboxylic acid were further added to carry out the reaction, which reaction was stopped at the time when the acid value reached 20.

The resulting resin is designated as "Resin C". This Resin C was in the form of a pale yellow solid, and the softening point of Resin C was measured in the same manner as for Resin A to find to be 130° C.

(4) Resin D (for the present invention):

| | |
|---|---|
| Polyoxypropylene(2,2)-2,2-bis-(4-hydroxyphenyl)propane | 698 g (2.03 mols) |
| Fumaric acid | 176 g (1.52 mols) |
| Diisopropyl orthotitanate (Esterified catalyst) | 0.8 g |

The above materials were reacted in the same manner as in the production of Resin A, and 65 g (0.34 mol) of an anhydride of 1,2,4-benzenetricarboxylic acid were further added to carry out the reaction, which reaction was stopped at the time when the acid value reached 21.

The resulting resin is designated as "Resin D". This Resin D was in the form of a pale yellow solid, and the softening point of Resin D Was measured in the same manner as for Resin A to find to be 134° C.

(5) Resin E (for comparison):

| | |
|---|---|
| Polyoxypropylene(2,2)-2,2-bis-(4-hydroxyphenyl)propane | 490 g (1.42 mols) |
| Polyoxyethylene(2,0)-2,2-bis(4-hydroxy-phenyl)propane | 193 g (0.61 mol) |
| Terephthalic acid | 103 g (0.62 mols) |
| Diisopropyl orthotitanate (Esterified catalyst) | 0.8 g |

The above materials were reacted in the same manner as in the production of Resin A, and 180 g (0.94 mol) of an anhydride of 1,2,4-benzenetricarboxylic acid were further added to carry out the reaction, which reaction was stopped at the time When the acid value reached 34.

The resulting resin is designated as "Resin E". This Resin E was in the form of a pale yellow solid, and the softening point of Resin E was measured in the same manner as for Resin A to find to be 135° C.

(6) Resin F (for comparison):

| | |
|---|---|
| Polyoxypropylene(2,2)-2,2-bis-(4-hydroxyphenyl)propane | 490 g (1.42 mols) |
| Poloxyethylene(2,0)-2,2-bis(4-hydroxy-phenyl)propane | 193 g (0.61 mol) |
| Fumaric acid | 225 g (1.94 mols) |
| Diisopropyl orthotitanate (Esterified catalyst) | 0.8 g |

The above materials were reacted in the same manner as in the production of Resin A, and 12 g (0.06 mol) of an anhydride of 1,2,4-benzenetricarboxylic acid were further added to carry out the reaction, which reaction was stopped at the time when the acid value reached 11.

The resulting resin 1s designated as "Resin F". This Resin F was in the form of a pale yellow solid, and the softening point of Resin F was measured in the same manner as for Resin A to find to be 130° C.

(7) Resin G (for comparison):

| | |
|---|---|
| Polyoxypropylene(2,2)-2,2-bis-(4-hydroxyphenyl)propane | 490 g (1.42 mols) |
| Polyoxyethylene(2,0)-2,2-bis(4-hydroxy-phenyl)propane | 193 g (0.61 mol) |
| Terephthalic acid | 169 g (1.02 mols) |
| Diisopropyl orthotitanate (Esterified catalyst) | 0.8 g |

The above materials were reacted in the same manner as in the production of Resin A, and 131% (0.68 mol) of an anhydride of 1,2,4-benzenetricarboxylic acid were further added to carry out the reaction, which reaction was stopped at the time when the acid value reached 30.

The resulting resin is designated as "Resin G". This Resin G was in the form of a pale yellow solid, and the softening point of Resin A was measured in the same manner as for Resin A to find to be 135° C.

(8) Resin H (for comparison):

| | |
|---|---|
| Polyoxypropylene(2,2)-2,2-bis-(4-hydroxyphenyl)propane | 490 g (1.42 mols) |
| Polyoxyethylene(2,0)-2,2-bis(4-hydroxy-phenyl)propane | 193 g (0.61 mol) |
| Adipic acid | 268 g (1.74 mols) |
| Diisopropyl orthotitanate (Esterified catalyst) | 0.8 g |

The above materials were reacted in the same manner as in the production of Resin A, and 37 g (0.19 mol) of an anhydride of 1,2,4-benzenetricarboxylic acid were further added to carry out the reaction, which reaction was stopped at the time when the acid value reached 18.

The resulting resin is designated as "Resin H". This Resin H was in the form of a pale yellow solid, and the softening point of Resin H was measured in the same manner as for Resin A to find to be 131° C.

| | |
|---|---|
| Example 1: | |
| Resin A (for the present invention) | 100 pbw |
| Carbon black | 10 pbw |
| Example 2: | |
| Resin B (for the present invention) | 100 pbw |
| Carbon black | 10 pbw |
| Example 3: | |
| Resin C (for the present invention) | 100 pbw |
| Carbon black | 10 pbw |
| Example 4: | |
| Resin D (for the present invention) | 100 pbw |
| Carbon black | 10 pbw |
| Comparative Example 1: | |
| Resin E (for comparison) | 100 pbw |
| Carbon black | 10 pbw |
| Comparative Example 2: | |
| Resin F (for comparison) | 100 pbw |
| Carbon black | 10 pbw |
| Comparative Example 3: | |
| Resin G (for comparison) | 100 pbw |
| Carbon black | 10 pbw |
| Comparative Example 4: | |
| Resin H (for comparison) | 100 pbw |
| Carbon black | 10 pbw |

In each of Examples and Comparative Examples, the materials of the recipe as shown were melted, kneaded, cooled, ground and classified according to the conventional toner production method to obtain a toner comprising particles having an average particle size of 10 μm. The toners obtained in Examples 1 to 4 are designated as "Toner 1" to "Toner 4", respectively, and the resulting toners obtained in Comparative Examples 1 to 4, as "Comparative Toner 1" to "Comparative Toner 4". respectively.

In respect of these toners, the minimum fixing temperature, offset occurring temperature, humidity dependence of electrical charge quantity, initial image density under a low humidity condition, and anti-blocking property were examined according to the following methods.

Minimum fixing temperature

Using an electrophotographic copying machine "U-Bix 5000" (produced by Konishiroku Photo Industry Co., Ltd.) equipped with a fixing device comprising a heated roller whose surface layer is formed with Teflon polytetrafluoroethylene, available from DuPont Co.) and a back-up roller formed by covering a rubber layer made of silicone rubber "KE-1300 RTV" (available from Shin-Etsu Chemical Co., Ltd.) with a Teflon tube, e procedure wherein a toner transferred to a transfer sheet of 64 g/m$^2$ is continuously and repeatedly fixed under the condition that the linear velocity of the heated roller has been set to 200 mm/sec and the temperature of the heated roller has been initially set to 240° C., was carried out until the temperature of the heated toller fell to 140° C., and the minimum heated roller temperature at which a fixed image showing sufficient resistance to the rub by kimwipe rubbing was obtained was regarded as the minimum fixing temperature. The fixing device used here has no silicone oil feeding mechanism. However, a cleaning roller is provided face to face, and in contact, with the heated roller.

Offset occurring temperature

A toner was transferred in the same manner as in the measurement of the minimum fixing temperature to carry out a fixing processing by use of the above-mentioned fixing device, and a white transfer sheet was subsequently fed to the fixing device under the same conditions to observe whether a toner stain is generated or not. This procedures were repeated under the condition that the heated roller temperature of the above fixing device was gradually lowered, and the minimum heated-roller temperature at which the toner stain was generated was regarded as the offset occurring temperature.

Humidity dependence of electrical charge quantity

An electrical charge quantity in a low humidity atmosphere (temperature: 10° C.; relative humidity: 20%) and an electrical charge quantity of a toner in a high humidity temperature (temperature: 33° C.; relative humidity: 80%) were measured according to the known blow-off method to evaluate whether the dependence is good or not, on the basis of the absolute value of the difference between the both. The smaller the numerical value is, the smaller the humidity dependence is to mean a good toner.

Meanwhile, the triboelectric charging was carried out by mixing with a carrier wIth stirring after the toner was allowed to stand in the respective atmospheres for 3 hours.

Initial image density under a low humidity condition

Using a modified machine of an electrophotographic copying machine U-Bix 5000 (produced by Konishiroku Photo Industry Co., Ltd.), copied images having a solid portion of the original density of 1.30 were formed by 10 sheets with use of a two component developer prepared by mixing 3.5 parts by weight of each of the above toners and 96.5 parts by weight of a carrier, and under a low humidity condition (temperature: 10° C., relative humidity: 20%), and an average value for the density of these images was regarded as the initial image density.

In this test, a carrier that can give an electrical charge quantity of the same level in any toners was selected to prepare the developer.

Anti-blocking property

A toner was allowed to stand for 48 hours under the environmental conditions of the temperature of 55° C. and relative humidity of 40%, and the property was evaluated on the basis of whether an agglomerate was formed in the toner. The case where no agglomerate was observed was evaluated as "A"; the case where some agglomerates were observed, as "B"; and the case where a great number of agglomerates were observed, as "C".

Results obtained in the above are shown in Table 1*a* and Table 1*b*.

TABLE 1a

| | Binder resin | | | |
|---|---|---|---|---|
| | | Acid components | | |
| Toner | Kind | Dicarboxylic acid | Tricarboxylic acid | Acid value |
| Toner 1 | Resin A | Fumaric acid 90 mol % | 1,2,4-BTCA* 10 mol % | 19 |
| Toner 2 | Resin B | Fumaric acid 75 mol % | 1,2,4-BTCA* 25 mol % | 22 |
| Toner 3 | Resin C | Mesaconic a. 80 mol % | 1,2,4-BTCA 20 mol % | 20 |
| Toner 4 | Resin D | Fumaric acid 82 mol % | 1,2,4-BTCA* 18 mol % | 21 |
| Comp. toner 1 | Resin E | Terephthalic a. 40 mol % | 1,2,4-BTCA* 60 mol % | 34 |
| Comp. Toner 2 | Resin F | Fumaric acid 97 mol % | 1,2,4-BTCA* 3 mol % | 11 |
| Comp. Toner 3 | Resin G | Fumaric acid 60 mol % | 1,2,4-BTCA* 40 mol % | 30 |
| Comp. Toner 4 | Resin H | Adipic acid 90 mol % | 1,2,4-BTCA* 10 mol % | 18 |

1,2,4-benzenetricarboxylic acid

TABLE 1b

| | Minimum | Offset | Environment dependence | | Anti- |
|---|---|---|---|---|---|
| Toner | fixing temp. (°C.) | Occurring temp. (°C.) | Change in e. charge quantity | Initial image density | blocking prop. |
| Toner 1 | 150 | 240 | 0 | 1.31 | A |
| Toner 2 | 160 | 240 | 2 | 1.30 | A |
| Toner 3 | 155 | 240 | 1 | 1.29 | A |
| Toner 4 | 155 | 240 | 1 | 1.30 | A |
| Comparative Toner 1 | 200 | 240 | 10 | 1.01 | A |
| Comparative Toner 2 | 165 | 190 | 0 | 1.32 | B |
| Comparative Toner 3 | 180 | 240 | 8 | 1.14 | A |
| Comparative Toner 4 | 160 | 24 | 1 | 1.30 | C |

As will be understood from the results shown in Table 1*a* and Table 1*b*, any of Toners 1 to 4 according to the present invention are excellent in respect of the low temperature fixing performance, anti-offset property, anti-blocking property and environment dependence of electrical charge quantity, and can stably form a good image at high speed regardless of the environmental conditions.

In contrast thereto, in Comparative Toner 1, wherein an aromatic dicarboxylic acid is used as the dicarboxylic acid component and, moreover, the proportion of the tricarboxylic acid is excessive in the formation of the resin, there are problems that the minimum fixing temperature is considerably high and also the environment dependence of electrical charge quantity is large.

In Comparative Toner 2, wherein the proportion of the tricarboxylic acid for forming the resin is excessively small, there are problems that the anti offset property is inferior and also the anti blocking property is somewhat inferior.

In Comparative Toner 3, wherein an aromatic dicarboxylic acid is used as the dicarboxylic acid component and, moreover, the proportion of the tricarboxylic acid is somewhat excessive in the formation of the resin, there are problems that the minimum fixing temperature is somewhat high and also the environment dependence of electrical charge quantity is large.

In Comparative Toner 4, wherein an aliphatic saturated dicarboxylic acid is used as the dicarboxylic acid component in the formation of the resin, there is a problem that the anti-blocking property is inferior Production of color toner (1) Toner 1' (for the present invention):

Using Resin A used in the foregoing Example 1, 100 parts by weight of Resin A, 7.5 parts by weight of a chromatic coloring agent "PV Fast Red B" (C.I. Pigment Red 149; available from Hoechst Japan Co.) and 4 parts by weight of polyolefin wax "Viscol 660P" (available from Sanyo Chemical Industries, Ltd.) Were mixed by use of a ball mill, and subjected to the respective steps for melt-kneading, grinding and classifying to obtain resin powder having an average particle size of 11 μm. To 100 parts by weight of this resin powder, 0.4 part by weight of a hydrophobic silica fine powder "Aerosil R-972" (available from Japan Aerosil Co.), 0.4 part by weight of a hydrophobic titanium oxide "T-805" (available from Japan Aerosil Co.) and 0.2 part by weight of zinc stearate were added, and these were mixed and stirred to obtain a color toner of the present invention. This is designated as "Toner 1'"

(2) Toner 2' (for the present invention):

The production of Toner 1' was repeated except that D used in the foregoing Example 4 was used in place of Resin A, to obtain a toner of the present invention. This is designated as "Toner 2'".

(3) Toner 3'" (for comparison):

The production of Toner 1 was repeated except that Resin E used in the foregoing Comparative Example 1 was used in place of Resin A, to obtain a comparative toner. This is designated as "Toner 3'".

(4) Toner 4' (for the present invention)

To 100 parts by weight of the resin powder having an average particle size of 11 μm, obtained in the production of Toner 1', 0.4 part by weight of a hydrophobic silica fine powder "Aerosil R-972 " (available from Japan Aerosil Co) and 0.2 part by weight of zinc stearate were added, and these were mixed and stirred to obtain a color toner of the present invention. This is designated as "Toner 4'"

Production of resin coated carrier (1) Carrier 1 (for the present invention):

In 500 ml of acetone, 12 g of a vinylidene fluoride-/ethylene tetrafluoride copolymer "VT-100" (copolymerization molar ratio: 80:20; intrinsic viscosity: 0.95dl/g; available from Daikin Industries, Ltd.) and 28 g of a fluorine-containing acrylic polymer, the aforesaid exemplary polymer (1) (intrinsic viscosity: 0.5 dl/g), were dissolved to prepare a coating solution. Subsequently, using a fluidized bed coating apparatus, the above coating solution was coated o the surface of 1kg of spherical ferrite particles (available from Nihon Teppun K. K.) to form a resin layer on each particle, thus obtaining a resin coated carrier of the present invention having a resin layer of 2 μm in average thickness. This is designated as Carrier 1.

(2) Carrier 2 (for the present invention):

In 500 ml of acetone, 28 g of a vinylidene fluoride-/ethylene tetrafluoride copolymer "VT- 100" (copolymerization molar ratio: 80:20 intrinsic viscosity: 0.95 dl/g; available from Daikin Industries, Ltd.) and 12 g of a methyl methacrylate copolymer "Acrypet MF" (available from Mitsubishi Rayon Co., Ltd.) were dissolved to prepare a coating solution. The production of Carrier 1 was repeated except for use of this coating solution, to obtain a resin coated carrier of the present invention. This is designated as "Carrier 2".

(3) Carrier 3 (for comparison):

In 500 ml of a toluene/methanol mixed solution (toluene:methanol =90:10, in volume ratio), 40 g of polystyrene were dissolved to prepare a coating solution. The production of Carrier 1 was repeated except for use of this coating solution, to obtain a comparative resin coated carrier. This is designated as "Carrier 3".

Examples 5 to 7 and Comparative Examples 5 to 7

The above toners and carriers were used in the combination as shown in Table 1*a* to prepare Developers 1 to 3 of the present invention and Comparative Developer 1 to 3. In each developer, the toner was used in concentration of 5% by weight in every case.

Next, by use of a modified machine of an electrophotographic copying machine "U-Bix 1800" (produced by Konishiroku Photo Industry Co., Ltd.), fitted with an organic photoconductive photosensitive member having negatively chargeable double layer structure constituted by using an anthoanthrone type pigment as a carrier generating material and by using a carbazole derivative as a carrier transporting material, and by use of the above respective developers, tests of continuously forming copied images on 60,000 sheets at the maximum were carried out to examine the durability of developers, initial image density, generation of fog, and occurrence of toner filming on the surface of the photosensitive member after formation of a final image. Results of these are shown in Table 1*b*.

In respect of the durability, evaluation was made based on the maximum copying times by which an image of a practically problem-free level can be obtained.

In respect of the measurement of the initial image density, copied images having a solid portion having the original density of 1.30 were formed on 10 sheets, and an average value of the image density of these was regarded as the initial image density.

The generation of fog was visually judged, and a sample with no fog observed was evaluated as "A"; a sample with some fogs observed, as "B"; and a sample with a large number of fogs observed, as "C".

The occurrence of toner filming on the surface of the photosensitive member was also visually judged, and a sample with no toner filming observed was evaluated as "A"; and a sample with some toner filming observed, as "B".

The minimum fixing temperature and the offset occurring temperature were further measured on the above respective developers in the same manner as in the tests for Examples 1 to 4 and Comparative Examples 1 to 4. Results of these are shown together in Table 1*b*.

TABLE 2a

| Developer | Toner: Type | Binder: Type and acid value | Binder: Acid components: Dicarboxylic acid | Binder: Acid components: Tricarboxylic acid | Carrier: Type | Carrier: Resin components of coating solution |
|---|---|---|---|---|---|---|
| Developer 1 | Toner 1' (For present inv.) | Resin A A.V.: 19 | Fumaric acid 90 mol % | 1,2,4-benzenetricarboxylic acid 10 mol % | Carrier 1 (For present inv.) | VF/ETF copolymer* (80:20) F-cont. acrylic polymer (1) |
| Developer 2 | Toner 1' (For present inv.) | Resin A A.V.: 19 | Fumaric acid 90 mol % | 1,2,4-benzenetricarboxylic acid 10 mol % | Carrier 2 (For present inv.) | VF/ETF copolymer* (80:20) Methyl methacrylate copolymer |
| Developer 3 | Toner 2' (For present inv.) | Resin D A.V.: 21 | Fumaric acid 82 mol % | 1,2,4-benzenetricarboxylic acid 18 mol % | Carrier 1 (For present inv.) | VF/ETF copolymer* (80:20) F-cont. acrylic polymer (1) |
| Comp. Developer 1 | Toner 3' (For comparison) | Resin E A.V.: 34 | Terephthalic acid 40 mol % | 1,2,4-benzenetricarboxylic acid 60 mol % | Carrier 1 (For present inv.) | VF/ETF copolymer* (80:20) F-cont. acrylic polymer (1) |
| Comp. Developer 2 | Toner 3' (For comparison) | Resin E A.V.: 34 | Terephthalic acid 40 mol % | 1,2,4-benzenetricarboxylic acid 60 mol % | Carrier 2 (For present inv.) | VF/ETF copolymer* (80:20) F-cont. acrylic polymer (1) |
| Developer 3 | Toner 4' (For present inv.) | Resin A A.V.: 19 | Fumaric acid 90 mol % | 1,2,4-benzenetricarboxylic acid 10 mol % | Carrier 3 (For comparison) | Polystyrene |

*Vinylidene fluoride/ethylene tetrafluoride copolymer

TABLE 2b

| Developer | Durability (Copies) | Initial image density | Fog | Toner* filming | Offset occurring temp. (°C.) | Minimum fixing temp. (°C.) |
|---|---|---|---|---|---|---|
| Developer 1 | 60,000 or more | 1.4 | A | A | 240 or more | 150 |
| Developer 2 | 55,000 | 1.4 | A | A | 240 or more | 150 |
| Developer 3 | 60,000 or more | 1.3 | A | A | 240 or more | 155 |
| Comparative Developer 1 | 40,000 | 1.3 | A | B | 240 or more | 180 |
| Comparative Developer 2 | 40,000 | 1.2 | B | B | 240 or more | 180 |
| Comparative Developer 3 | 1,000 | 0.8 | C | C | 240 or more | 150 |

*on the surface of a photosensitive member

As will be understood from the results shown in Table 2*a* and Table 2*b*, any of Developers 1 to 3 according to the present invention have sufficient durability, have high image density, suffer no generation of fog, and suffer no filming. They are also excellent in the low temperature fixing performance and anti-offset property, and can stably form a good image at high speed regardless of the environmental conditions.

In contrast thereto, in Comparative Developers 1 and 2, wherein an aromatic dicarboxylic acid is used as the dicarboxylic acid component and, moreover, the proportion of the tricarboxylic acid is excessive in the formation of the resin, there are problems that the minimum fixing temperature is high and that these developers have inferiority in respect of the toner filming and durability.

In Comparative Developer 3, wherein the resin layer of the resin coated carrier does not contain the fluorine-containing resin, there are problems that this toner have inferiority in respect of the durability, fog and toner filming.

What is claimed is:

1. A developer composition for developing an electrostatic latent image comprising:

(1) a color toner comprising (i) a polyester resin obtained by polymerizing by condensation polymerization:

(a) a mixture of diol components comprising diols represented by the formula (1):

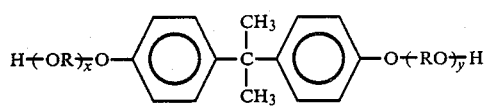

(1)

wherein R is an ethylene group or a propylene group, x and y represent integers and the average of the total sum of x and y is from 2 to 7, and (b) a mixture of acid components comprising an aliphatic unsaturated dicarboxylic acid, an acid anhydride thereof or a derivative thereof and a polybasic carboxylic acid having not less than three carboxylic acid groups or an acid anhydride thereof, the proportion of the content of said polybasic carboxylic acid having not less than three carboxylic acid groups or the acid anhydride thereof to the total acid components being from 5 mol % to less than 30 mol %, and (ii) a chromatic coloring agent; and (2) a resin coated carrier comprising a core material and a resin layer coated thereon, said resin layer containing a vinylidene fluoride/ethylene tetrafluoride copolymer and a polymer having at least one of monomer components represented by the following formulas I and II:

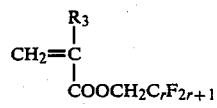

Formula I

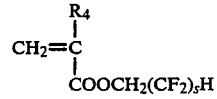

Formula II wherein $R_3$ and $R_4$ each represent a hydrogen atom or a methyl group, r represents 1 or 2, and s represents an integer of 2 to 4.

2. The developer of claim 1, wherein said aliphatic unsaturated dicarboxylic acid is at least one member selected from the group consisting of fumaric acid, maleic acid, citraconic acid, mesaconic acid, itaconic acid and gulutaconic acid.

3. The developer of claim 1, wherein said polybasic carboxylic acid is 1,2,4-benzenetricarboxylic acid.

4. The developer of claim 1, wherein the amount of said chromatic coloring agent to be contained in said color toner is from 3 to 20 parts by weight based on 100 parts by weight of the polyester resin of said color toner.

5. The developer of claim 1, wherein the copolymerization molar ratio of said vinylidene fluoride/ethylene tetrafluoride is between 75:25 and 95:5.

6. The developer of claim 1, wherein the polymerization molar ratio of said vinylidene fluoride/ethylene tetrafluoride is between 75:25 and 87.5:12.5.

7. The developer of claim 1, wherein the weight average particle size of said resin coated carrier is from 10 to 1000 μm.

8. The developer of claim 1, wherein the weight average particle size of said resin coated carrier is from 20 to 300 μm.

9. The developer of claim 1, wherein the thickness of said resin layer is from 0.01 to 20 μm.

10. The developer of claim 1, wherein the thickness of said resin layer is from 0.1 to 3 μm.

* * * * *